United States Patent [19]

Van Fossen

[11] 4,319,436

[45] Mar. 16, 1982

[54] PORTABLE BLASTING DEVICE AND SEALING MEANS

[75] Inventor: Harvey G. Van Fossen, Mishawaka, Ind.

[73] Assignee: Wheelabrator-Frye, Inc., Mishawaka, Ind.

[21] Appl. No.: 117,843

[22] Filed: Feb. 4, 1980

[51] Int. Cl.[3] ..... B24C 3/06; B24C 9/00

[52] U.S. Cl. ..... 51/424; 51/429; 51/430

[58] Field of Search ..... 51/424, 425, 426, 429, 51/430

[56] References Cited

U.S. PATENT DOCUMENTS

| | | | |
|---|---|---|---|
| 2,729,918 | 1/1956 | Van Denburgh | 51/429 |
| 2,924,911 | 2/1960 | Leliaert | 51/426 |
| 3,788,010 | 1/1974 | Goff | 51/429 X |
| 3,900,968 | 8/1975 | Shigyo | 51/429 X |
| 4,020,596 | 5/1977 | Bergh | 51/429 |

*Primary Examiner*—Nicholas P. Godici

*Attorney, Agent, or Firm*—McDougall, Hersh & Scott

[57] ABSTRACT

A portable blasting device in which the space between the blast head and the surface being treated is provided with a magnetic seal formed of the particulate material with apparatus for maintaining the magnet supports for relative movement to maintain the sealed spaced relation notwithstanding unevenness of the surface.

10 Claims, 3 Drawing Figures

PORTABLE BLASTING DEVICE AND SEALING MEANS

This invention relates to the treatment of surfaces by projection of a particulate material onto the surface to be treated and it relates more particularly to means for confining the particulate material projected onto the surface while permitting relative movement between the device and the surface.

The invention will be described with reference to a portable device embodying an airless blasting wheel for projection of particulate material onto a surface to be treated. It will be understood, however, that the invention has application also to other devices whereby particulate material is projected onto a surface for treatment.

Airless blasting wheels are well known to the art. Such wheels, which are marketed by Wheelabrator-Frye Inc. under the trademark WHEELABRATOR comprise a plurality of circumferentially spaced apart blades which extend radially outwardly from a central hub with means for feeding particulate material onto the inner ends of the blades whereby the material is displaced along the surfaces of the blades in response to rapid rotational movement of the wheel and are thrown at high velocity from the ends of the blades onto the surface to be treated. Depending somewhat upon the type of surface treatment, that is cleaning, abrading, peening or the like, the treating material is selected of abrasive particles, steel shot, steel grit and the like particulate materials.

In the use of such devices for blasting or impacting surfaces with the particulate material, it is desirable to confine the space about the surface being treated to permit recovery of particulate material and to prevent the development of hazardous conditions resulting from the ricocheting of particulate material into the surrounding atmosphere. In a portable device which is moved over the surface, the blast housing cannot be permanently attached to the surface to effect the desired sealing relation. The desired sealing relation is further complicated by the fact that the surfaces are not even so that variations are encountered in the spaced relation between the blast head and the surface.

With a view towards overcoming these problems, attempts have been made to make use of flexible sealing members formed of rubber or polyurethane to conform to the surface. These materials are so rapidly eroded by the blast of particular materials as to require frequent replacement. In addition, a considerable amount of pressure is required to be applied to such sealing members in order to achieve conformance with the contour of the surface, with the result that such sealing members are subject to considerable wear by abrasion with the surface. Thus, such flexible sealing members are handicapped by very short seal life and require frequent replacement.

It is an object of this invention to provide a sealing means and method for portable blasting equipment of the type described whereby the particulate material is effectively confined within the blast housing while materially reducing the amount of seal wear, drag force and pressure required to maintain the blast head in sealing engagement with the surface during treatment of the surface.

These and other objects and advantages of this invention will hereinafter appear and for purposes of illustration, but not of limitation, an embodiment of the invention is shown in the accompanying drawings in which.

Figure 1:
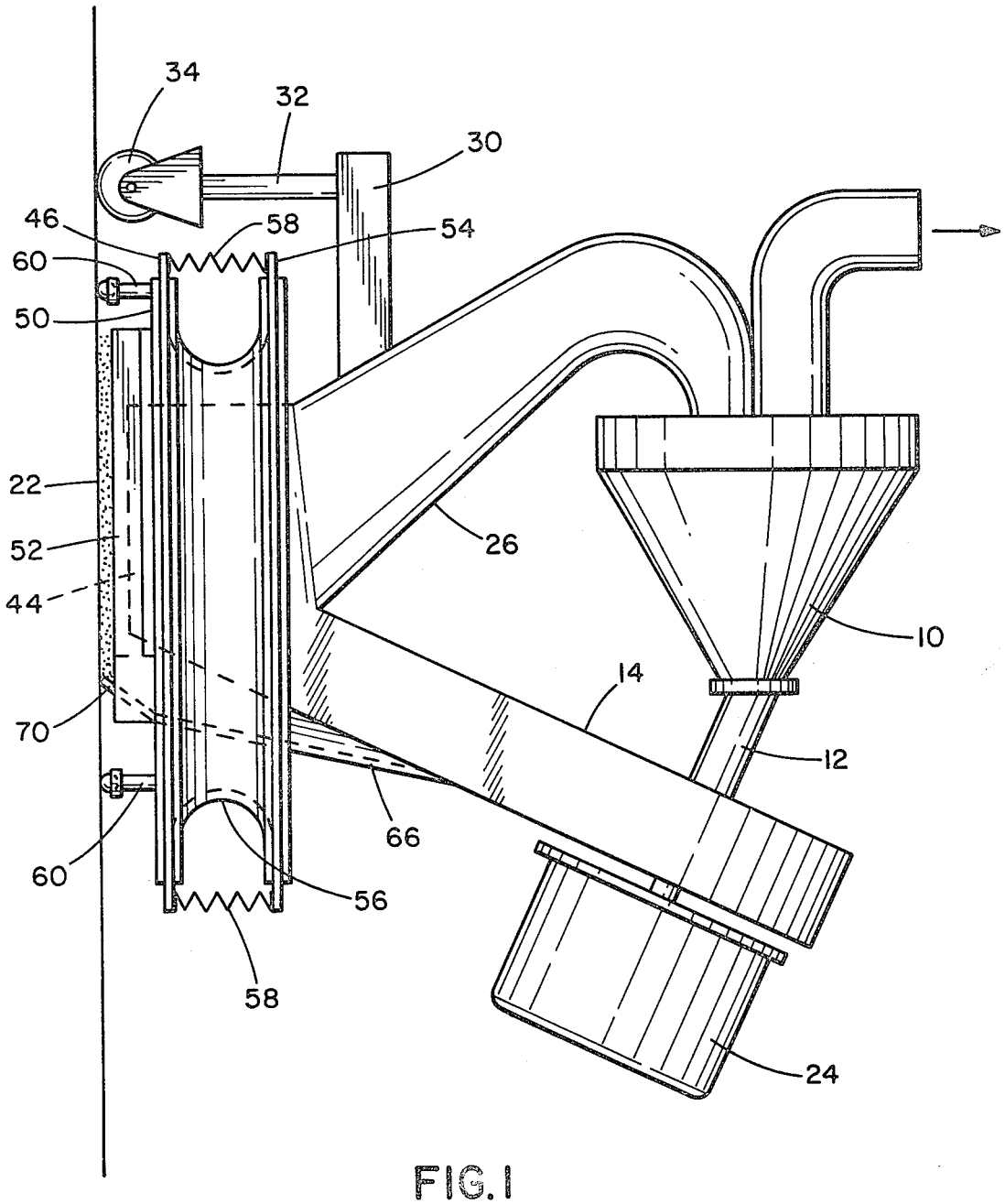
FIG. 1 is a schematic elevational view of a portable surface treating device embodying the features of this invention.

The invention will be described with particular reference to a portable centrifugal blasting device in which the particulate material is steel shot or grit for peening or cleaning a metal surface, such as a ship's hull or storage tank as by the removal of rust, dirt or paint.

Referring now to the drawings, the steel shot is fed from a hopper 10 through a feed tube 12 to the feed cage of a multi-bladed centrifugal blast wheel (not shown) mounted for rotational movement within the outer end portion of a blast corridor 14 through which the shot is projected from the ends of the blades in the direction of the arrows 16 and through a blast opening 20 onto the surface 22 to be treated. The bladed wheel is adapted to be rotated at high speed by an electrical motor 24.

Upon impact with the surface 22, the shot rebounds with sufficient kinetic energy for travel through an upwardly inclined rebound corridor 26 for return to the hopper 10. An air wash of conventional construction may be included in the return for the removal of dust and dirt from the steel particles which are returned to the hopper 10 for reuse.

The foregoing describes the basic elements of the blade head for blasting a surface for treatment with particulate material. In a portable unit, the blast head is carried by a frame 30 having adjustable spindles 32 for mounting rollers 34 for facilitating rolling displacement of the blast head over the surface 22. The spindles are adapted to be adjustable in length for varying the spacing between the blast head and the surface.

Briefly described, the seal between the blast head and the surface is formed of the particulate material, as represented be steel shot or grit, held together by magnetic attraction induced by permanent magnets mounted immediately adjacent the top and side walls of the blast head on supports which are movable relative to the blast head in order to maintain a uniform spaced relation with the surface regardless of the unevenness of the surface, and means constantly urging the support in the direction towards the surface to give effect to the spacing means. Since the seal is formed of the particulate material projected through the blast head onto the surface, the seal will automatically form almost immediately from the initial material thrown through the blast head onto the surface.

Referring now to the drawings for a more detailed description of the invention, the blast head is illustrated as having an enclosure formed of a top wall 36, side walls 38 and 40 and a bottom wall 42 which define a blast opening 44 of substantially rectangular shape facing the surface 22 to be treated. A support plate 46, having an opening 48 through which the blast head extends, is provided with a magnetic shield 50 on which permanent magnets 52 are secured to extend in closely spaced relation to the side and top walls 36 to 40 respectively of the blast head to surround the top and sides of the opening 44.

A mounting plate 54 is fixedly secured to the housing in spaced parallel relation rearwardly of the support plate 46 and is provided with an opening through which the blast head extends. The mounting plate 54 is joined to the support plate 46 by a bellows 56 to enable endwise movement of the support plate 46 relative to the mounting plate 54 in the direction towards and away from the surface 22. Means are provided constantly to urge the support plate in the direction away from the mounting plate in the direction towards the surface. Such means are depicted in the drawings as coil springs 58 mounted at one end to the support plate and at the other end to the mounting plate to extend therebetween.

Figure 2:
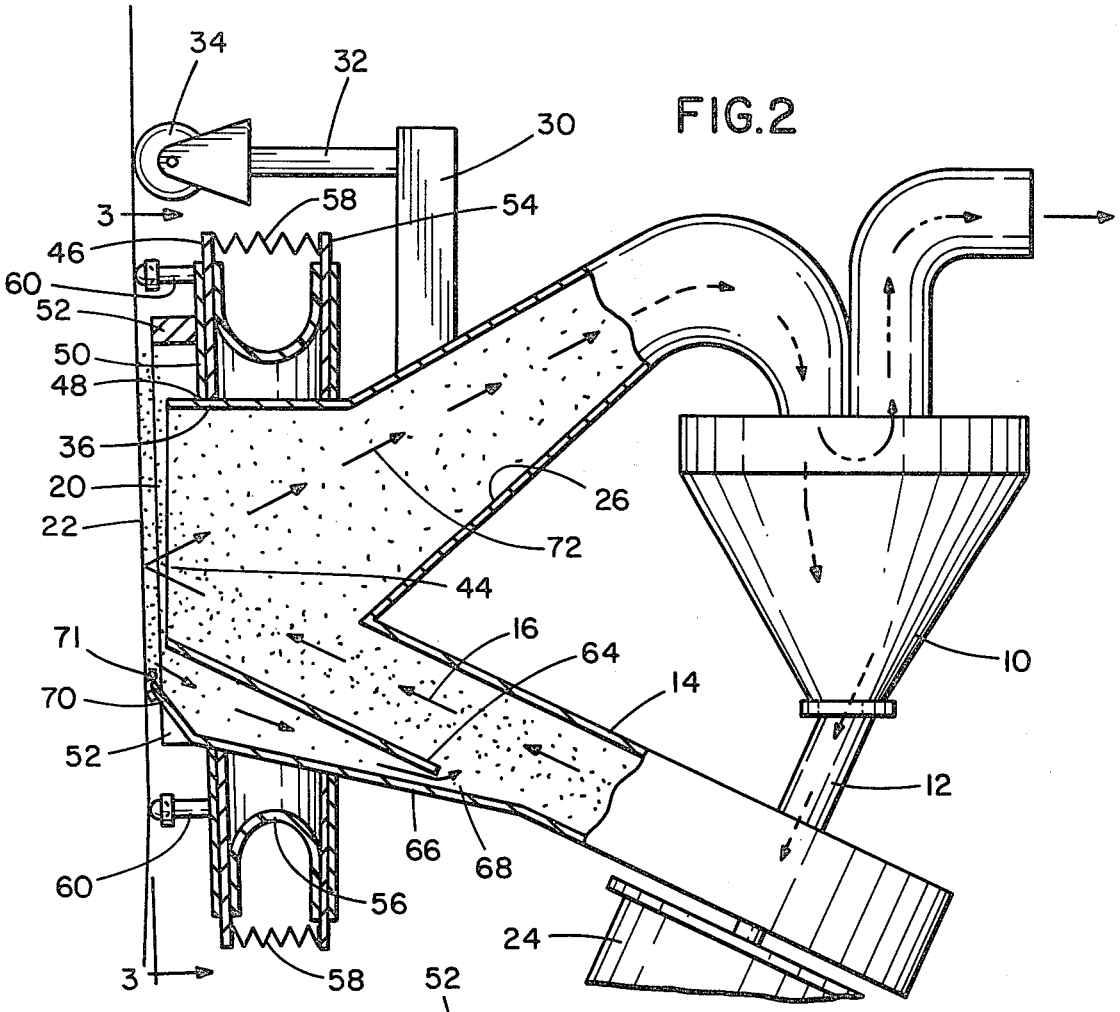
FIG. 2 is a view similar to that of FIG. 1 showing the relationship between elements when in operative engagement with an uneven surface.

Guide means are provided for maintaining a uniform spaced relation between the support plate and the surface 22 independent of the contour of the surface. Such guide means comprises adjustable spacer rods 60 fixed to the corner portions of the support plate 46 with antifriction means, such as rollers or balls 62 on the ends thereof for rolling engagement with the surface. Thus, as illustrated in FIG. 2, the bellows springs 58 operate constantly to urge the spacer rods 60 into engagement with the surface 22 such that the spaced relation between the support plate 46 and the surface will remain substantially constant. As a result, the magnetic shot seal will not be affected by changes in contour of the surface thereby to enable the shot seal to remain effective in the maintenance of a sealing relationship between the surface and the blast head.

Such permanent magnets to maintain a shot seal is not provided across the bottom side of the blast opening. This is to enable particulate material to fall gravitationally through the opening between the bottom side of the blast head and the surface. In order to gather the particulate material that does not rebound but instead falls gravitationally downward from the surface, the blast head is provided with a drain below the bottom wall 64 of the blast corridor including an upwardly inclined plate 66 which extends from an open slot 68 between the rearward end portion of the bottom wall of the blast corridor and drain plate 66, and a portion 70 which extends upwardly at a sharp incline for a distance to extend beyond the blast head for engagement with the surface 22, when the blast head is in operative position, to deflect falling abrasive particles onto the inclined plate 66 for drainage back through the slot 68 to the wheel.

The deflector 70 is preferably formed of an elongate strip of resilient plastic in order to serve both as a seal as well as a deflector. Although not essential, it is preferred to provide the leading edge of the deflector with a slide shoe 71, preferably of metal, in order to enable the deflector plate to ride over seams and the like which otherwise might fold back to deflect with the undesirable release of entrapped shot or grit. The shoe also operates to provide an air gap and an effective induced air seal between the deflector 70 and the surface 22.

In operation, the blast head is brought into facing relation with the surface to be treated until the spacer roller 34 comes into engagement with the surface. The wheel is then rotated at high speed and steel shot is fed from the hopper 10 onto the inner end portions of the blades whereby the shot is thrown in the conventional manner from the ends of the rapidly rotating blades for projection at high velocity through the upwardly inclined blast corridor onto the surface 22 confronting the blast opening 20 of the blast head. For the most part, the steel shot rebounds at a reflective angle, indicated by the arrows 72, through the rebound corridor for return to the hopper 10 after having been processed by an air cleaner for removal of dust, dirt and foreign material. That which does not rebound by reason of interference or the like, falls gravitationally over the surface and is deflected by the bottom seal plates 70 and 66 for return to the wheel.

The steel shot or grit thrown onto the surface is attracted by the magnets 52 with the result that such steel shot and grit is held by magnetic attraction to fill the space between the magnets and the surface thereby to develop a magnetic seal which blocks openings through which shot can ricochet into the atmosphere surrounding the blast head. The shot seal represents a fluid seal which is constantly capable of replacement thereby to eliminate the problems of wear or abrasion. The magnetic seal formed of the particulate material is characterized somewhat as a rolling seal which introduces little if any drag or resistance to movement of the blast head over the surface being treated.

By reason of the floating support for the described magnetic members, the character and the dimension of the seal is maintained relatively constant notwithstanding deviations in the coutour of the surface thereby to minimize the deterioration of the seal effect in use.

Figure 3:
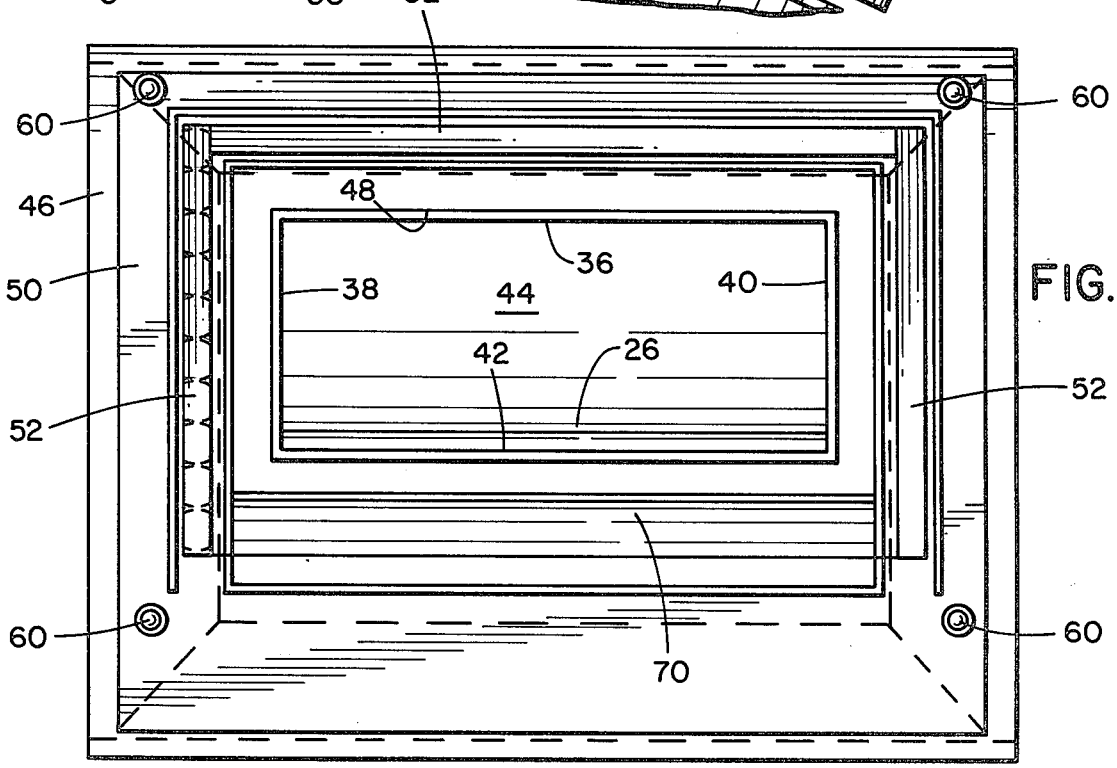
FIG. 3 is a front elevational view of the elements forming the part of the blast head in the blast zone.

In the preferred practice of the invention, the side and top magnets 52 are in the form of segmented magnets arranged in end to end relation, as shown by the broken line to the left in FIG. 3. This enables better conformance with the surface 22 for optimum sealing, especially in the cleaning or treatment of relatively sharply curved surfaces, such as small diameter tanks.

It will be apparent that the sealing means embodying the features of this invention is applicable to other devices for blasting surfaces with material characterized by magnetic attraction.

It will be understood that changes may be made in the details of construction, arrangement and operation without departing from the spirit of the invention, especially as defined in the following claims.

I claim:

1. In a portable blasting device having a head with an opening through which the particulate material is projected at high velocity onto a vertically disposed surface for surface treatment and in which the particulate material is characterized by magnetic attraction, means for building up and maintaining a sealed relation between the blast head and the surface about the top and sides of the opening comprising a support plate mounted for movement relative to the blast head about the opening, magnetic members mounted on the support plate about the top and sides of said opening, means constantly urging the support plate in the direction toward the surface and guide means extending a predetermined distance from the support plate to maintain the spaced relation between the magnetic members on the support plate and the surface whereby particulate material is held by magnetic attraction to form a seal of particulate material between the blast head and the surface about the top and sides of the opening, leaving an open space between the blast head and the surface extending substantially across the bottom side of said opening, and means below the bottom side of said opening for receiving particulate material falling gravitationally from the surface through said open space.

2. A device as claimed in claim 1 in which the particulate material is steel shot or steel grit.

3. A device as claimed in claim 1 in which the projecting means is a bladed centrifugal blasting wheel.

4. A device as claimed in claim 1 which includes adjustable means for guiding the blast head in spaced relation with the surface independent of the support plate.

5. A device as claimed in claim 1 in which the means maintaining the support plate for movement relative to the blast head comprises a mounting plate fixed to the blast head in spaced relation rearwardly of the support plate, a bellows disposed between the support plate with the mounting plate for sole support of the support plate from the end of the bellows and to enable endwise displacement of the support plate relative to the mounting plate and means constantly urging the support plate in the direction away from the mounting plate, in the direction towards the surface.

6. A device as claimed in claim 5, in which means constantly urging the support plate in the direction away from the mounting plate comprises spring members disposed between the support plate and the mounting plate.

7. A device as claimed in claim 1, in which the guide means comprises adjustable rods fixed to extend forwardly from the support plate and anti-friction means on the ends of the rods for engagement with the surface.

8. A device as claimed in claim 1 in which the magnets are segmented and arranged in end to end relation about the top and sides of the opening.

9. In a portable blasting device having a head with an opening through which the particulate material is projected at high velocity onto a surface for surface treatment and in which the particulate material is characterized by magnetic attraction, means for building up and maintaining a sealed relation between the blast head and the surface about the opening comprising a support plate mounted for movement relative to the blast head about the opening, magnet members mounted on the support plate about said opening, means constantly urging the support plate in the direction toward the surface and guide means extending a predetermined distance from the support plate to maintain the spaced relation between the support plate and the surface whereby particulate material is held by magnetic attraction to form a seal of particulate material between the blast head and the surface, said magnetic members being mounted on the support plate about the top and sides of the blast opening, leaving an open space between the blast head and the surface about the bottom side of the blast opening, and in which the device includes drain plates having a portion which extends forwardly beyond the blast head for engagement with the surface to deflect particulate material falling through said open space and for draining the material back into the blast head and in which the drain comprises a plate located below the bottom side of the blast head, said drain plate having a downwardly inclined end portion which extends beyond the end of the blast head and which leads to a downwardly inclined body portion which extends rearwardly to an opening in communication with the blast head to drain particulate material into the blast head.

10. A device as claimed in claim 9 in which the downwardly inclined end portion of the drain plate is formed of a flexible material and which includes a rigid shoe on the end of the downwardly inclined portion to guide the flexible downwardly inclined portion over the surface.

* * * * *